United States Patent [19]

Zink et al.

[11] 4,004,875

[45] Jan. 25, 1977

[54] LOW NOX BURNER

[75] Inventors: John Smith Zink; Hershel E. Goodnight, both of Tulsa, Okla.

[73] Assignee: John Zink Company, Tulsa, Okla.

[22] Filed: Jan. 23, 1975

[21] Appl. No.: 543,231

[52] U.S. Cl. ..... 431/9; 431/116; 431/187

[51] Int. Cl.[2] ..... F23J 15/00

[58] Field of Search ..... 431/115, 116, 9, 187, 431/188

[56] References Cited

UNITED STATES PATENTS

| | | | |
|---|---|---|---|
| 2,247,768 | 7/1941 | Huwyler | 431/188 |
| 2,269,333 | 1/1942 | Bloom | 431/188 |
| 2,672,190 | 3/1954 | Schumann | 431/188 |
| 2,857,961 | 10/1958 | Brown et al. | 431/116 |
| 2,918,117 | 12/1959 | Griffin | 431/116 |
| 3,217,779 | 11/1965 | Reed et al. | 431/285 |

*Primary Examiner*—Carroll B. Dority, Jr.
*Attorney, Agent, or Firm*—Head, Johnson & Chafin

[57] ABSTRACT

An improved burner for both liquid and gaseous fuels in which the combustion air is divided into at least two parts, comprising primary and secondary air. The primary air, which is insufficient to completely burn the fuel, creates a flame zone in which there is a deficiency of air, which produces quantities of carbon monoxide and hydrogen. The combustion products are recirculated, cooled and re-entered into the combustion zone in the region of the fuel and primary air entry, resulting in a reduction in the oxides of nitrogen. The secondary air, in quantities greater than the primary air, is introduced into a second combustion zone downstream of the first combustion zone. In the second combustion zone the deficiency in air is made up by the secondary air so that complete combustion can be carried out. If desired, a third quantity of air can be introduced still farther downstream in the flame zone.

5 Claims, 1 Drawing Figure

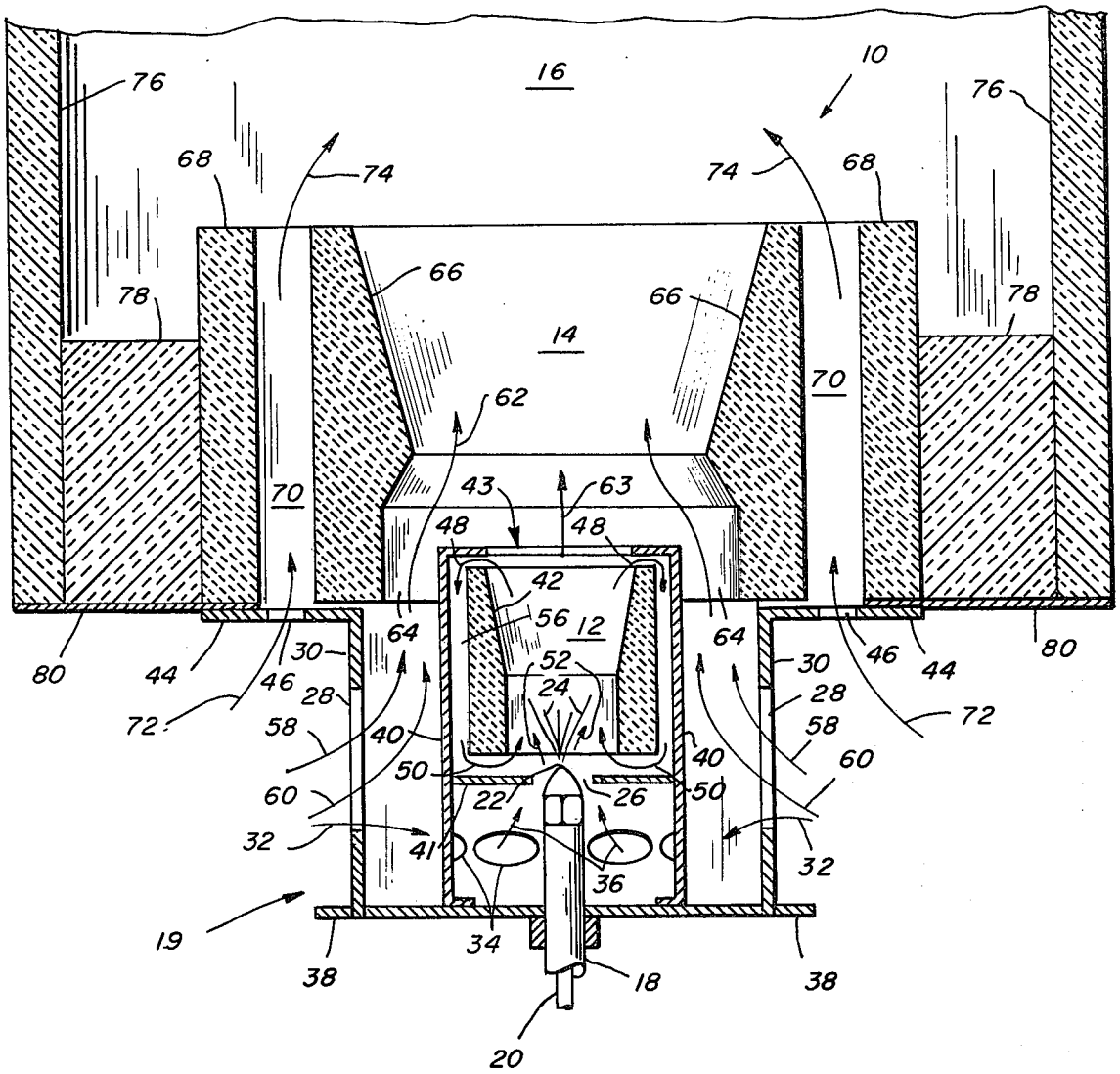
10
16
76
76
68
68
74
74
66
66
78
78
14
70
70
62
43
63
48
48
42
56
12
64
64
30
30
52
24
28
28
58
58
40
40
50
50
60
60
22
26
32
32
41
36
34
19
38
38
18
20
80
80
44
44
46
46
72
72

LOW NOX BURNER

BACKGROUND OF THE INVENTION

The burning of fuels, however it is accomplished in burners as now known in the art of fuel burning, is productive of oxides of nitrogen (NOx) in normal operation. Such oxides of nitrogen as are produced, in combination with olefinic hydrocarbons, which may be present in the atmosphere, constitute a source of smog.

Smog, while not necessarily lethal is recognized universally as potentially damaging to animal tissue. Consequently, severe limitations on the Nox content of stack gases vented to the atmosphere, as a result of fuels burning, have been imposed by various governmental authorities and agencies. Emission of olefinic hydrocarbons is also subject to limitation, but is a matter separate from the invention of this application.

Research has shown clearly that when cooled combustion gases are recirculated for mixture with air for combustion prior to entry of the air-flue gas mixture to the combustion reaction zone in a burner, the result is reduced NOx concentration in the combustion gases following the combustion. Since the flue gases contain $CO_2$ and water vapor this desirable result is probably due to the following high temperature chemistries:

$$CO_2 + CH_4 = 2\ CO + 2\ H_2$$
$$H_2O + CH_4 = CO + 3H_2$$

These reactions occur within the body of the flame in regions where oxygen is not present but NOx is present. The NOx promptly reacts with both carbon monoxide and hydrogen as sources of oxygen, with formation of carbon dioxide and water and to produce lowered NOx in the flue gases emitted from the venting device to the atmosphere. This condition is where combustion is complete prior to flue gas recirculation and cooling.

Further research has shown with equal clarity, that if the combustion gases are from incomplete combustion and are also cooled prior to mixture with the air for combustion, the presence in them of both carbon monoxide and hydrogen resulting from incomplete combustion, as well as carbon dioxide and water vapor further reduces NOx emission to levels of concentration in flue gases significantly below the emission state due to the carbon dioxide, water vapor and methane reaction alone. Research has shown then that for minimum NOx emission in combustion gases there should be recirculation of the combustion gases as discussed. The recirculated combustion gases require cooling and they should be from an area where combustion is not complete.

It is known in the art to withdraw stack gases which have been cooled by heat utilization, and to deliver the cooled stack combustion gases to selected burner areas for NOx reduction. Thus the simple recirculation of combustion gases is known in the art. However, in this invention, the recirculation gases are drawn from an area where the combustion is not complete. Also, cooling of the gases is a characteristic of the burner structure of this invention. Furthermore, no external ducts or vents are required for combustion as recycling.

SUMMARY OF THE INVENTION

This invention lies in the field of combustion of fuels. More particularly, it is concerned with the combustion of liquid or gaseous fuels in such a manner as to minimize the emission of NOx in the flue gases.

It is a primary object of this invention to provide a combustion burner wherein the NOx emission is reduced. It is a further object of the invention to provide reduced NOx emission by recirculating combustion products from a zone in which combustion is carried out with deficiency of air, cooling the recirculated combustion products and re-entering them into the upstream end of the combustion zone.

These and other objects are realized and the limiations of the prior art are overcome in this invention by creating a burner in which there are two zones of combustion, a first upstream zone wherein the primary air is limited to insure that there is a deficiency of air, and there is incomplete combustion. Part of the products of combustion are recirculated from the outlet of the first zone, cooled and re-entered into the first combustion zone in the vicinity of the fuel and primary air inlet. As the combustion products move downstream to a second combustion zone, secondary air in volumes greater than the primary air enters, to complete the combustion in a zone having an excess of air. There are two critical parts to this system. The first involves recirculation of the products of combustion which are derived from a first combustion zone in which there is deficiency of primary air. The second point is that there is a cooling of these products of combustion being recirculated prior, to a re-entry to the first combustion zone.

BRIEF DESCRIPTION OF THE DRAWING

These and other objects and advantages of this invention and a better understanding of the principles and details of the invention will be evident from the following description taken in conjunction with the appended drawing, which illustrates in cross-section, the construction of the burner system of this invention.

DESCRIPTION OF THE PREFERRED EMBODIMENT

Referring now to the drawing, there is shown as indicated by the numeral 10, one embodiment of this invention. It shows a combustion device having two zones of combustion; an upstream zone 12 and a downstream zone 14, with a flame zone 16 inside of the furnace enclosure. While the principle of this improved low NOx burner can be used with either liquid or gaseous fuels, it will be illustrated with a burner system utilizing liquid fuels.

A burner support structure illustrated generally by the numeral 19 is shown for supporting the structure of the burner at the base of the furnace indicated by the furnace walls 76 and furnace base 78, resting on supporting plates 80 attached to and part of the support structure 19.

The fuel is supplied through an oil gun assembly 18 which contains a conduit 20 for the delivery of fuel oil, and possibly also conduit means for the introduction of gaseous atomizing means with the fuel as desired. A nozzle 22 is provided at the upper end of the fuel gun 18, and fuel is sprayed 24 into the first combustion zone 12. A tile 42 is provided surrounding the sprayed fuel 24, so as to provide a high temperature environment for the fuel and air mixture so as to promote combustion.

The zone 12 and the tile 42 are completely surrounded, except for the open end 43 of the tile, by a steel enclosure 40 on the side and 41 on the bottom. There is an opening 26 in the bottom of the enclosure through which the fuel gun is partially inserted leaving an annular space for the flow of primary air, as shown by the arrows 36, into the combustion space 12. The enclosure 40 and 41, is supported on a plate 38 which is attached to a cylindrical wall 30 and plate 44 as part of the support structure 19.

Primary and secondary air enters through large openings 28 in the cylindrical wall 30. The primary air, as indicated by arrows 32, flows through the opening 28 and through a plurality of openings 34 in the enclosure wall 40 and then proceeds as indicated by arrows 36 to the opening 26 into and surrounding the fuel spray 24, to carry on partial combustion of the fuel in the zone 12.

The amount of primary air permitted through the opening 26 is less than that required to fully combust the fuel, so that there is present, in the products of combustion, carbon monoxide and hydrogen, which are the results of the incomplete combustion. Part of this partially combusted fuel and air is recirculated in accordance with arrows 48 and 50 around the outside of the tile 42 in an annular space 56 between the tile 42 and the enclosure 40 and down below the tile in accordance with arrow 50 and back into the combustion zone 12.

Secondary air, in accordance with arrows 58 and 60, flows through the openings 28 and up along the wall 40 of the enclosure, and through an annular opening 64 between the enclosure 40 and a tile 66 and in accordance with arrow 62 into the second combustion zone 14. As the secondary air flows along the wall 40, it cools the wall, which is heated by the passage of the hot products of combustion 48 on their way down through the annular space 56. The tooled wall 40 cools the products of combustion so that the flow indicated by arrow 50 contains cooled carbon monoxide and hydrogen and other products of combustion. The carbon monoxide and hydrogen along with the entering air and fuel, mix in the combustion zone 12, the fuel searching for oxygen. Carbon monoxide and hydrogen, searching for oxygen with a deficiency in air flow, take the oxygen from the nitrogen oxides, thereby reducing the quantity of NOx in the fuel products mixture in the zone 12, as they flow in accordance with arrow 63 into the downstream combustion zone 14.

In the second combustion zone 14, secondary air as indicated by arrow 62 mixes with the products of combustion inside of the tile 66 and provide a complete combustion of the fuel into carbon dioxide and water. However, because of the reduction of NOx in the upstream combustion zone 12 there will be a reduced quantity of NOx in the gases emitted from the burner.

Additional air, in the form of tertiary air, in accordance with arrow 72 may be provided up through an annular space between the tile 66 and a surrounding cylindrical tile 68. Here the gases are heated by contact with the tile 66 and proceed as arrow 74 into the flame zone 16 of the furnace.

The primary ar 36 is drawn into the combustion zone 12 as a result of the high velocity flow of the oil droplets 24, which are released under pressure through the nozzle 22. If desired, and in addition, steam can be injected through the nozzle for purposes of improving combustion, and also for increasing the velocity of the fuel droplets. This high velocity flow induces the draft through the opening 26 so that the pressure in the combustion zone 12 is actually lower at the point of injection of fuel than it is at the upper end of the tile 42. Thus, there is a reduction in pressure along the annular channel 56, tending to draw gaseous products 48 from the combustion zone 12. Thus, no additional devices are needed to provide the circulation of combustion products through the annular zone 56, which are cooled by contact with the wall 40 as they are recycled into the upstream end of the combustion zone 12.

It will be clear that should it be desired to introduce a gaseous fuel into the furnace that such fuel could be introduced by a circular burner arranged in the annular opening 64 by means well known in the art.

While the invention has been described with a certain degree of particularity, it is manifest that many changes may be made in the details of construction and the arrangement of components. It is understood that the invention is not to be limited to the specific embodiments set forth herein by way of exemplifying the invention, but the invention is to be limited only by the scope of the attached claim or claims, including the full range of equivalency to which each element or step thereof is entitled.

What is claimed is:

1. A fluid fuel burner designed to produce minimum quantities of NOx, comprising:

a. a nozzle for injection of fuel into a first combustion zone surrounded by a first ceramic tile, and means to supply said fuel under pressure to said nozzle;

b. means adjacent said nozzle to supply a limited volume of primary air in the region of said nozzle, the volume being insufficient for complete combustion of said fuel;

c. an enclosure means surrounding and spaced from said first ceramic tile to define a first annular space communicating the outlet of said first combustion zone with the region of said nozzle;

d. means to recirculate a portion of the products of combustion from said first combustion zone around the outside of said first tile through said annular space to the vicinity of said nozzle;

e. a cylindrical wall annularly spaced from and surrounding said enclosure, said wall having openings therein to supply therethrough air, a portion of which becomes said volume of primary air, a remaining and larger portion being secondary air;

f. means to supply said secondary air in heat exchange relation with the outside of said enclosure means to cool said recirculated products thence to a second combustion zone downstream from said first combustion zone, the quantity of secondary air being sufficient to theoretically completely combust said fuel, said second zone surrounded by second ceramic tile;

g. a second annular space surrounding said second tile in communication with the outlet of said second combustion zone; and h. means to supply tertiary air to said outlet of said second combustion zone via said second annular space.

2. The burner as in claim 1 wherein said fuel is a liquid fuel and includes means to inject steam therewith said liquid fuel.

3. The burner as in claim 1 wherein said enclosure means is metallic.

4. The burner as in claim 1 wherein means to recirculate comprises means by which the velocity flow of said fuel creates a pressure at the inlet to said first combustion zone which is lower than the pressure at the outlet of said first combustion zone; whereby said portion of recirculation products of combustion from said first zone will be caused to flow back from the outlet of said first zone through said first annular space to the inlet of said first zone.

5. A method of burning fuels so as to produce minimum quantities of NOx, comprising the steps of:

injecting said fuel under pressure through a nozzle to a first combustion zone surrounded by a first refractory, supplying, to the region of said nozzle, a volume of primary air in an amount insufficient to complete the combustion of said fuel, recirculating a confined portion of the products of combustion from the outlet of said first zone to the vicinity of said fuel injection, supplying air to a space surrounding said first combustion zone, and dividing said air such that a portion becomes said volume of primary air, while a remaining and larger portion becomes secondary air, supplying said secondary air in heat exchange relation with said recirculating products to a second combustion zone axially downstream from said first zone, said second zone surrounded by a second refractory, the quantity of said secondary air being sufficient to completely combust said fuel, and supplying a separate confined volume of tertiary air around and on heat exchange relation with said second refractory to the outlet of said second combustion zone.

* * * * *